US010962259B2

(12) United States Patent
Shah et al.

(10) Patent No.: US 10,962,259 B2
(45) Date of Patent: Mar. 30, 2021

(54) SEGREGATED FIRED HEATER

(71) Applicant: UOP LLC, Des Plaines, IL (US)

(72) Inventors: Chintan Surendra Shah, Gujarat (IN); Nitin Prabhakar Chitgopekar, Hoffman Estates, IL (US)

(73) Assignee: UOP LLC, Des Plaines, IL (US)

( * ) Notice: Subject to any disclaimer, the term of this patent is extended or adjusted under 35 U.S.C. 154(b) by 375 days.

(21) Appl. No.: 16/119,315

(22) Filed: Aug. 31, 2018

(65) Prior Publication Data

US 2020/0072503 A1 Mar. 5, 2020

(51) Int. Cl.

| | |
|---|---|
| ***F24H 9/20*** | (2006.01) |
| ***F24H 1/14*** | (2006.01) |
| ***F24H 9/18*** | (2006.01) |
| ***F24H 9/14*** | (2006.01) |

(52) U.S. Cl.

CPC ..... *F24H 9/2035* (2013.01); *F24H 1/145* (2013.01); *F24H 9/142* (2013.01); *F24H 9/146* (2013.01); *F24H 9/1836* (2013.01)

(58) Field of Classification Search

CPC ..... F24H 9/2035

See application file for complete search history.

(56) References Cited

U.S. PATENT DOCUMENTS 2,346,345 A * 4/1944 Angell ..... C10G 9/20 122/356
2,769,772 A * 11/1956 Gomory ..... C10G 9/36 208/130
2,898,892 A * 8/1959 Campbell ..... C10G 9/20 122/356
3,274,978 A * 9/1966 Palchik ..... C10G 9/20 122/356
3,487,121 A * 12/1969 Hallee ..... C07C 5/327 585/652
4,454,839 A * 6/1984 Gater ..... B01J 8/062 122/18.4
4,732,740 A * 3/1988 Woebcke ..... C10G 51/023 422/204
7,004,085 B2 2/2006 Platvoet et al.
7,718,052 B2 * 5/2010 Brewer ..... C10G 9/20 208/132
8,282,814 B2 * 10/2012 Peters ..... C10G 29/205 208/63
9,327,259 B2 * 5/2016 Hartman ..... C10G 35/04

FOREIGN PATENT DOCUMENTS

EP 2949728 A1 2/2015
FR 2133306 A5 11/1972

OTHER PUBLICATIONS

International Search report from PCT/US2019/048513, dated Nov. 28, 2019.
Written Opinion from PCT/US2019/048513, dated Nov. 28, 2019.

* cited by examiner

*Primary Examiner* — Nathaniel Herzfeld

(57) ABSTRACT

A fired heater has two cells segregated by an insulative wall. A first plurality of burners are located in the first cell and a second plurality of burners are located in the second cell. A radiant tube extends from the first cell to the second cell for carrying a fluid material through the heater to heat the fluid material. The flow of fuel to the burners in either the first cell or the second cell can be terminated to accommodate lower heater duty when demand is lower.

14 Claims, 3 Drawing Sheets

SEGREGATED FIRED HEATER

BACKGROUND

Fired heaters burn hydrocarbon fuels to indirectly exchange heat with a process fluid in route to a process unit. In hydrocarbon processing technologies, operators would like to turn down heater duty to meet the process unit demand. Turn down for various operating cases can be as low as 25% of the heater design duty.

Due to environmental regulations that tend to reduce the allowable emissions to the environment, there is an increasing demand that fired heaters be equipped with low NOx burners. For low NOx burners to have stable operation, ensure flame stability and minimize CO emissions, there is need to maintain a minimum bridge wall temperature (BWT) which is the temperature of the flue gas when it exits the radiant section of the heater and transitions to the convection section of the heater. Furthermore, operation with excess air may also be required at high turndown conditions to maintain stable burner operation which negatively affects fuel efficiency of the heater. BWT decreases as the heater turndown increases. Consequently, turndown duty that a fired heater can achieve is limited and often a compromise heat integration scheme must be developed to utilize the excess heater duty generated.

A fired heater that can be turned down to a greater degree and meet these other considerations would be greatly desired.

SUMMARY

We have discovered a fired heater that has an insulative wall that separates a first cell from a second cell. A first plurality of burners are located in the first cell, and a second plurality of burners are located in the second cell. A radiant tube extending from the first cell to the second cell carries a fluid material through the heater to heat the fluid material. The burners in either the first cell or the second cell can be fully turned down to accommodate lower heater duty demand. Such fired heater arrangement facilitates improvement of radiant fuel efficiency by 2 to 4% due to proper control of excess air level thus reducing fuel consumption and green-house emissions substantially.

DETAILED DESCRIPTION

Figure 1:
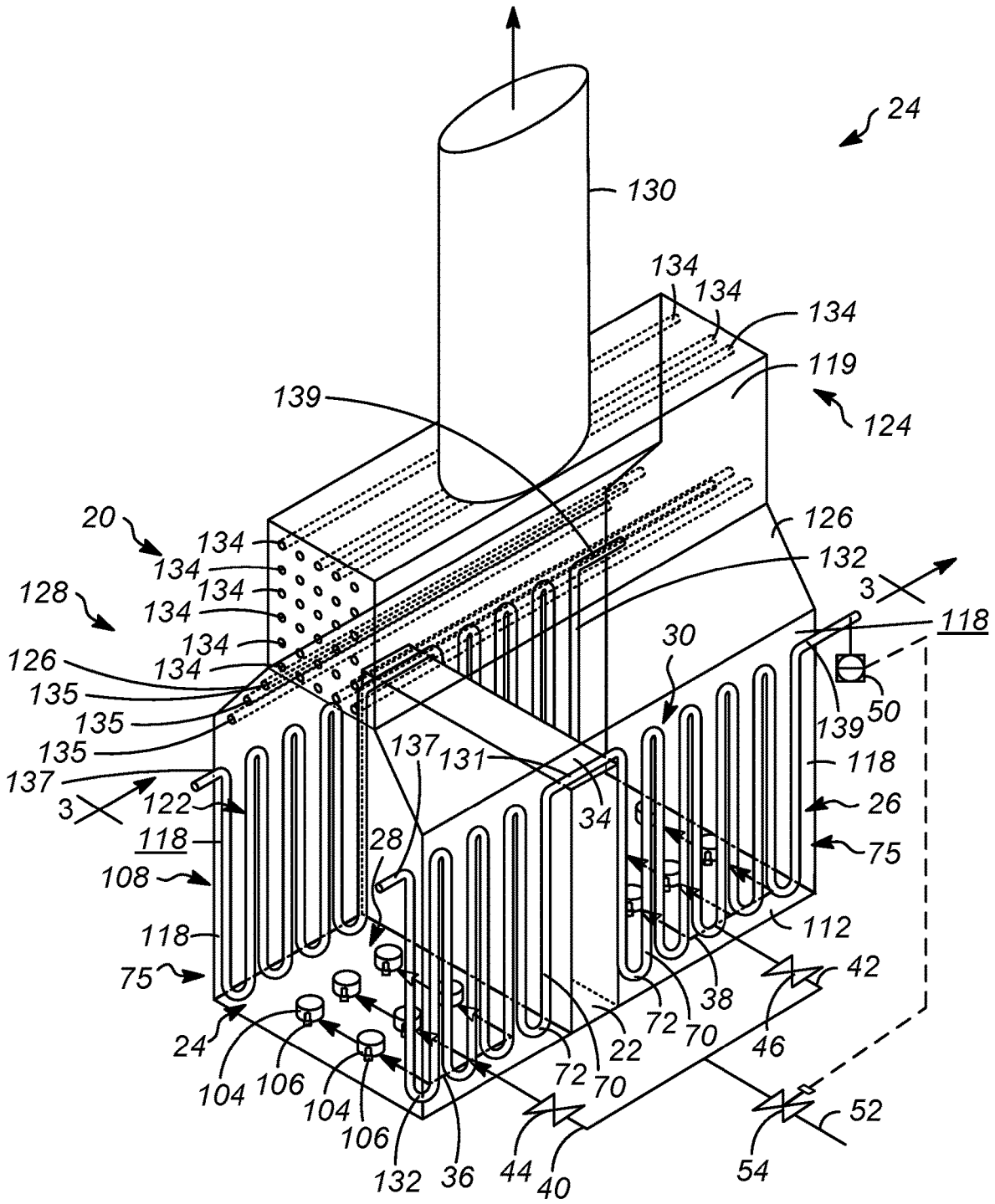
FIG. 1 is an isometric view of a fired heater of the present.

A new fired heater 20 is illustrated by the drawing in FIG. 1. FIG. 1 is an isometric drawing of one embodiment of the fired heater 20 and indicates the main features without being restricted to the exact geometry shown. The fired heater 20 comprises a furnace cabin or firebox 108 having a plurality of vertical, outer walls 118 and a floor 112 which define a radiant section 122, a convection section 124 and a stack 130. The radiant section 122 in the firebox 108 has a primary mode of heat transfer by radiation. Vertical, outer walls 118 may adjoin roofs 126. The roofs may be sloped to define an optional transition section 128 between the radiant section 122 and the convection section 124. The roofs 126 may be horizontal and/or provide no transition section. The outer walls 118 of the furnace cabin 108 define the radiant section 122 and the roofs 126 over the radiant section may extend inwardly from the outer walls.

A transition section 128 may be provided where the cross sectional area of the firebox 108 first begins to gradually decrease along its height or width from the cross sectional area of the radiant section 122. The border between the radiant section 122 and the convection section 124, or with the transition section 128, if there is one, is where the cross sectional area of the firebox 108 first begins to decrease along its height or width from the cross sectional area of the radiant section such as in this case at the transition section 128. The convection section 124 includes a largest horizontal cross sectional area which is smaller than a largest horizontal cross sectional area of the radiant section. The convection section 124 in the firebox 108 has a primary mode of heat transfer by convection.

The radiant section 122 contains a radiant tube 132, and the convection section 124 contains a convection tube 134. The radiant tube 132 carries a fluid material through the radiant section 122 of the heater to heat the fluid material in the radiant tube by indirect heat exchange, primarily by radiation heat transfer. The convection tube 134 carries a fluid material through the convection section 124 of the heater to heat the fluid material in the convection tube by indirect heat exchange, primarily by convective heat transfer. The radiant section 122 may contain a plurality of radiant tubes 132, and the convection section 124 may contain a plurality of convection tubes 134. The convection tubes 134 may have a smooth outside surface, or the convection tubes 134 may have studs or fins welded to the outside surface. The radiant tube 132 is preferably serpentine but it may be straight. The convection tube 134 is preferably straight but it may be serpentine.

The radiant tube 132 may be serpentine comprising long straight segments 70 between curved sections 72. In FIG. 1, the radiant tubes 132 have four pairs of straight sections or passes 75 in the first cell 24 and five pairs of straight sections or passes 75 in the second cell 26. The number of passes 75 relate to the amount of heater duty absorbed by the radiant tube 132. The ratio of the volume of the first cell 24 to the volume of the second cell 26 may be 1:1 to 4:1, such as no more than 3:2 or no more than 3:1. The ratio of passes in the first cell 24 to the second cell 26 may be 1:1 to 4:1, such as no more than 3:2 or no more than 3:1. Similarly, the ratio of the quantity of absorbed heat duty absorbed by the radiant tube in the first cell to the quantity of absorbed heat duty absorbed by the radiant tube in the second cell may be 1:1 to 4:1, such as no more than 3:2 or no more than 3:1. It is also envisioned that each cell may have radiant tubes 132 of different diameters with or without the same number of passes 75 in each cell. Radiant tubes 132 of different diameters would allow optimization of pressure drop and allow variation of mass velocity inside each tube 133 to manage fluid peak film temperature and thereby control degradation and coke rate.

Burners 104 are provided in the floor 112 of the fired heater 20. Each burner is equipped with a pilot burner 106. The burners 104 are designed for fuel gas but may be designed for burning liquid fuel or a combination fuel gas and liquid fuel. In an embodiment, fuel oil may be used as fuel in one cell; whereas, fuel gas may be uses as fuel in another cell. In an embodiment, the burners 104 may be located in the floor, but the surface burners may be located along the walls. The pilot burner 106 for each burner may remain lit at all times.

The heating tubes in the fired heater 20 carry fluid material such as crude oil or hydrocarbon charge stock through the fired heater 20 to be heated. Radiant tubes 132 are disposed along opposed walls 118 of the radiant section 122. Banks or rows of convection tubes 134 are disposed through the open space between the walls 119 in the convection section 124. The lowest rows, for example, the lowest three rows, of convection tubes 134 are shock tubes 135. These shock tubes 135 absorb both radiation heat from the radiant section 122 and convection heat from the flue gas flowing through convection section 124. The shock tubes 135 may be disposed in the transition section 128. The convection tubes 134 in the preferred embodiment would be disposed in a triangular pitch, but may be disposed in a square pitch. Multiple banks of convection tubes 134 may be suitable. In an embodiment, 10 to 20 rows of convection tubes 134 may be used, but more or fewer rows of convection tubes may be suitable. Multiple flue gas ducts (not shown) at the top of the convection section 124 may route to one stack 130. In a preferred embodiment there will be one to three flue gas ducts at the top of the convection section 124 routing flue gas to the stack 130.

The burners 104 may be arrayed in two rows on the floor 112 of the radiant section 122 although other arrays may be suitable. Preferably, 10 to 200 burners 104 may be provided in the radiant section 122 although as little as two burners may be suitable.

An insulative wall 22 is interposed in the firebox 108 to separate a first 24 cell from a second cell 26 in the radiant section 122. The wall may be solid refractory but preferably it comprises a hollow rectangular prismatic shell of refractory material that may be filled with air. A first plurality 28 of burners 104 may be located in the first cell 24 on one side of the insulative wall 22 and a second plurality 30 of burners 104 may be located in the second cell 26 on the other side of the insulative wall. A first manifold 36 may communicate with and feed fuel to the first plurality 28 of burners 104 in the first cell 24, and a second manifold 38 may communicate and feed fuel to the second plurality 30 of burners in the second cell 26. The first plurality 28 of burners 104 may comprise more, the same or less number of burners than the second plurality 30 of burners 104.

The insulative wall 22 may extend horizontally and/or laterally across the entire radiant section 122 but extend vertically in the radiant section to short of a top of the radiant section, the convection section 124 or the transition section 128, if there is one. The insulative wall 22 may extend vertically to short of the roof 126, such that a vertical gap 34 is provided between the top of the radiant section 122 and/or the lowest part of the roof 126 and a top of the insulative wall 22. The insulative wall should extend at least 33%, suitably at least 50% and preferably at least 70% of the height of the radiant section 122. The insulative wall may extend at least 80% of the height of the radiant section 122. The insulative wall may extend at least 90% of the height of the radiant section 122. The insulative wall may extend at least 95% of the height of the radiant section 122.

The radiant tube 132 traverses the insulative wall 22. As shown in FIG. 1, the radiant tube has a horizontal segment or jumpover 131 that extends above the top of the insulative wall 22. It is also envisioned that the horizontal segment 131 of the radiant tube 132 could penetrate through an opening in the insulative wall 22.

In operation, fluid material such as a hydrocarbon to be heated for entry into a process unit may be fed through the radiant tube 132 extending in the first cell 24 of the heater 20 across or traversing the insulative wall 22 and extending in the second cell 26 of the heater 20. It is envisioned that either the first cell 24 or the second cell 26 may house an inlet end 137 for the radiant tube 133, and the second cell 26 or the first cell 24 house the outlet end 139 of the radiant tube. A first stream of fuel in a first fuel line 40 may be fed through the first manifold 36 to the first plurality 28 of burners 104 in the first cell 24 to be combusted to heat the fluid material in the radiant tube 132 in the first cell. A second stream of fuel in a second fuel line 42 may be fed through the second manifold 38 to the second plurality 30 of burners 104 in the second cell 26 to be combusted to heat the fluid material in the radiant tube 132 in the second cell.

The first control valve 44 can be operated to regulate the flow of fuel therethrough to the first manifold 36 independently of the second control valve 46, and the second control valve 46 can be operated to regulate the flow of fuel therethrough to the second manifold 38 independently of the first control valve 44. For example, the flow of fuel in the first fuel line 40 through the first control valve 44 to the first plurality 28 of burners 104 in the first cell 24 may be terminated by closing the first control valve 44 without adjusting the second control valve 46. Moreover, the flow of fuel in the second fuel line 42 through the second control valve 46 to the second plurality 30 of burners 104 in the second cell 26 may be terminated by closing the second control valve 46 without adjusting the first control valve 44. Similarly, the flow of fuel in the first fuel line 40 through the first control valve 44 to the first plurality 28 of burners 104 in the first cell 24 may be initiated by opening the first control valve without adjusting the second control valve 46. Moreover, the flow of fuel in the second fuel line 42 through the second control valve 46 to the second plurality 30 of burners 104 in the second cell 26 may be initiated by opening the second control valve without adjusting the first control valve 44.

A preferred arrangement is that one of the two control valves 44, 46 will always be open. Both control valves 44, 46, in an aspect, are either both open or only one is closed, but both are not closed unless the heater itself is completely turned off. The pilot burners 106 to all of the burners 104 are fed with fuel from a different manifold and are typically always lit. In an embodiment, the control valves 44, 46 may only be set to open or closed.

The temperature of the fluid material exiting the second cell may be measured by a temperature monitoring device 50 which may comprise a temperature indicator controller comprising a sensor that may include a thermocouple on the radiant tube 132 exiting the heater 20, perhaps from the second cell 26. The temperature monitoring device 50 may transmit a signal comprising the measured temperature value to a computer which compares it to a set point or the temperature indicator controller integral to the temperature monitoring device may compare the temperature value to a set point. In the embodiment in which the control valves 44, 46 may only be set to open or closed, if the temperature value is below the set point, the temperature indicator controller or the computer signals a main control valve 54 on a burner line 52 that feeds both fuel lines 40 and 42 to open more to allow more fuel flow to one or both of the fuel lines 40 and 42. If the temperature is above the set point, the temperature indicator controller or the computer signals the main control valve 54 on the burner line 52 to close more to allow less fuel to one or both of the fuel lines 40 and 42. In this embodiment, because each of the control valves 44, 46 are either both open or only one is open, but both are not closed, control of the rate of flow of fuel to each cell 24, 26 can be controlled through the main control valve 54.

It is also envisioned that a single manifold may feed all of the burners 104 in both the first cell 24 and the second cell 26 and that dedicated burner valves be utilized to turn down or close fuel flow to one or both of the first cell and the second cell.

The innovative segregation of the first cell 24 from the second cell 26 by interposing between the two cells an insulative wall allows one of the first cell 24 and the second cell 26 to be completely turned down when less heater duty is demanded. Because the pilot burners 106 are always lit, the turned down cell can be quickly lit back up when higher duty demand is resumed or needed. The insulative wall 22 prevents segments of the radiant tube 132 in one cell 24, 26 from receiving radiant heat from burners 104 in another cell 26, 24. Hence, the operator has the flexibility to decide to operate either both cells for heater duty demand or only one of the cells in response to changes in duty demand. Because the burners 104 in the turned down cell 24, 26 are not operating, the minimum bridge wall temperature; e.g., flue gas temperature exiting the radiant section, is not implicated. In an example in which the second cell 26 has twice the volume and heat release capacity of the burners 104 as the first cell 24, the heater 20 may be operated at 100% of heater duty, 33% of heater duty by operating only the first cell 24 or 67% of heater duty by operating only the second cell.

In an alternative embodiment, the control valves 44, 46 may be set to adjustable degrees of partially open between fully open and fully closed positions.

The first control valve 44 and the second control valve 46 can be operated to allow more fuel through one of the control valves compared to the other control valve to transfer more heat to the fluid material in the radiant tube 134 in one cell 24, 26 than in the other cell. This arrangement may provide greater heat flux at the inlet of the radiant tube 132 perhaps in the first cell 24 than in the second cell 26 to foster heat input advantages and thus resulting in higher radiant and higher overall fuel efficiency across the fired heater 20.

Other variations and embodiments of the fired heater of the invention are contemplated. For example, the fired heater may incorporate an induced draft fan connected to the stack 130 to allow the convection section to be designed for high flue gas mass flux to minimize convection section capital cost.

Figure 2:
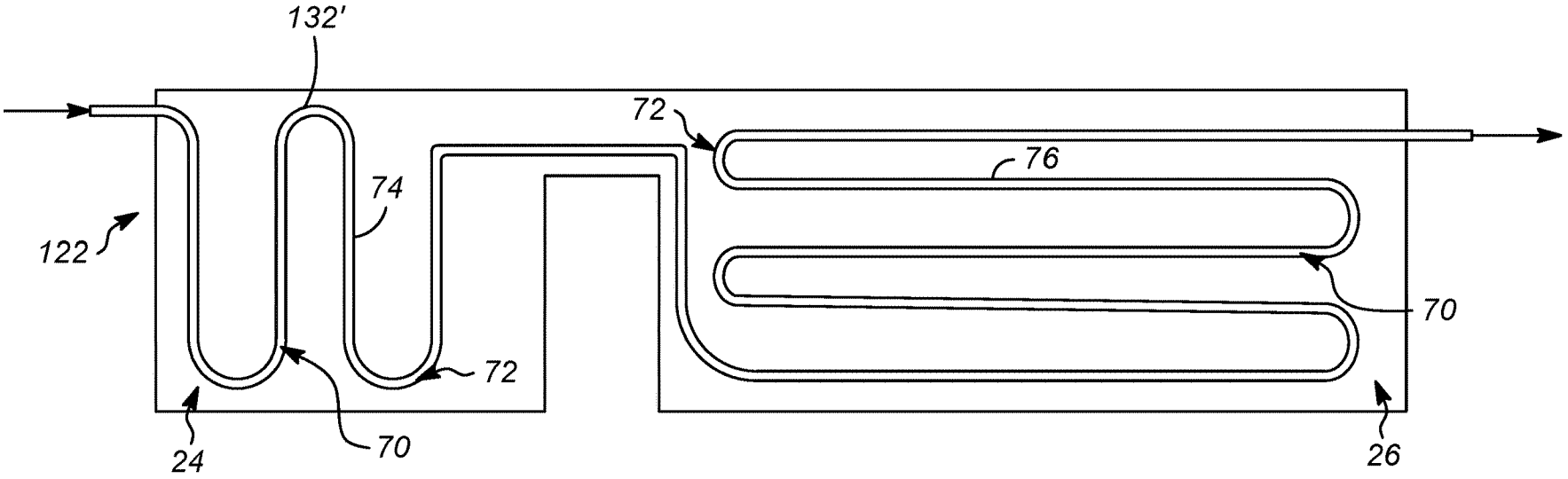
FIG. 2 is a partial elevational view of an alternative fired heater.

FIG. 2 is a partial elevational view that shows the first cell 24 and the second cell 26 and a radiant tube 132' extending through the radiant section 122. The radiant tube 132' is serpentine comprising long straight segments 70 between curved sections 72. The radiant tube 132' has a different configuration than the radiant tubes 132 shown in FIG. 1. In the first cell 24, the long straight segments 70 are vertical segments 74 and in the second cell the long straight segments 70 are horizontal segments 76. Accordingly, long straight segments 70 of the radiant tube 134' in the first cell 24 have a first orientation that is perpendicular to a second orientation of long straight segments 70 of the radiant tube in the second cell 26. Fluid material predominantly flows in a first orientation in the radiant tube 132' in the first cell 24 that may be horizontal, and fluid material predominantly flows in a second orientation that is perpendicular to the first orientation in the tube in the second cell 26 which may be vertical. The orientations may be switched between the first cell 24 and the second cell 26.

Figure 3:
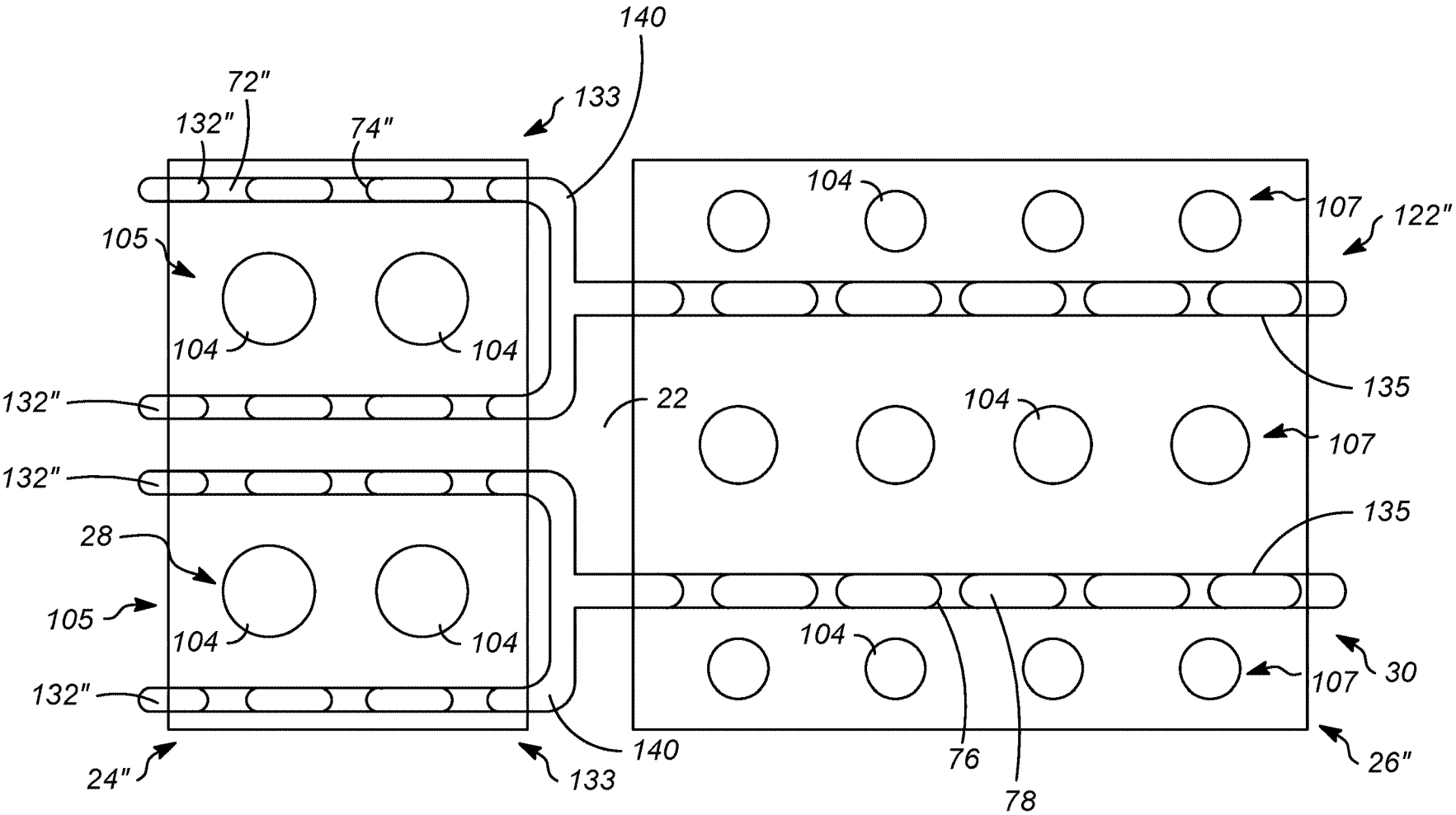
FIG. 3 is a partial sectional view of a further alternative fired heater.

FIG. 3 is a sectional view of the radiant section 122" that shows the first cell 24" and the second cell 26" taken along the plane defined by segment 3-3 in FIG. 1. A configuration of radiant tubes 132" and burners 104 in the radiant section 122" is different in FIG. 3 than in FIG. 1. Radiant tubes 132" are shown by sides of the vertical straight segments 74" and alternating tops and bottoms of their curved sections 72" in the first cell 24". Four radiant tubes 132" are provided in the first cell 24" with two rows 105 of burners 104 between respective pairs 133 of radiant tubes 132". In the second cell 26", two radiant tubes 135 are interleaved between respective ones of three rows 107 of burners 104. Radiant tubes 135 are shown by sides of the vertical straight segments 76 and alternating tops and bottoms of their curved sections 78. A juxtaposition of a radiant tube 132" and a first plurality 28 of burners 104 in the first cell 24" is different from a juxtaposition of a radiant tube 135 and a second plurality 30 of burners in the second cell 26". The juxtaposition of the radiant tube 132" and a first plurality 28 of burners 104 in the first cell 24" is radiant tube, row 105 of burners 104, radiant tube, radiant tube, row of burners, and radiant tube from a lateral standpoint. The juxtaposition of the radiant tube 135 and the second plurality 30 of burners 104 in the second cell 26" is row 107 of burners 104, radiant tube 135, row of burners, radian tube, row of burners. Moreover, a ratio of radiant tubes 132" to rows 105 of burners 104 is different in the first cell 24" than a ratio of radiant tubes 135 to rows 107 of burners 104 in the second cell 26". The ratio of radiant tubes 132" to rows 105 of burners 104 is 2:1 in the first cell 24" and the ratio of radiant tubes 135 to rows 107 of burners 104 in the second cell 26" is lower at 2:3. The burners 104 in the middle between radiant tubes 135 may be slightly larger burners because they are transferring heat to two radiant tubes 135 on both sides of each burner. Bridge connectors 140 traverses an insulative wall 22 from the first cell 24" to the second cell 26" to connect a pair 133 of radiant tubes 132" in the first cell to a single radiant tube 135 in the second cell. The insulative wall 22 is instrumental for enabling this arrangement to ensure portions of radiant tubes in one cell 24", 26" do not receive too much or too little heat from adjacent burners of a different arrangement in the adjacent cell 26", 24".

Any of the above lines, units, separators, columns, surrounding environments, zones or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect.

Signals, measurements, and/or data generated or recorded by monitoring components may be transmitted to one or more computing devices or systems. Computing devices or systems may include at least one processor and memory storing computer-readable instructions that, when executed by the at least one processor, cause the one or more computing devices to perform a process that may include one or more steps. For example, the one or more computing devices may be configured to receive, from one or more monitoring components, data related to at least one piece of equipment associated with the process. The one or more computing devices or systems may be configured to analyze the data. Based on analyzing the data, the one or more computing devices or systems may be configured to determine one or more recommended adjustments to one or more parameters of one or more processes described herein. The one or more computing devices or systems may be configured to transmit encrypted or unencrypted data that includes the one or more recommended adjustments to the one or more parameters of the one or more processes described herein.

SPECIFIC EMBODIMENTS

While the following is described in conjunction with specific embodiments, it will be understood that this description is intended to illustrate and not limit the scope of the preceding description and the appended claims.

A first embodiment of the invention is a fired heater comprising a plurality of walls and a floor; an insulative wall in the heater, the insulative wall separating a first cell from a second cell; a first plurality of burners in the first cell and a second plurality of burners in the second cell; a radiant tube extending from the first cell to the second cell for carrying a fluid material through the heater to heat the fluid material. An embodiment of the invention is one, any or all of prior embodiments in this paragraph up through the first embodiment in this paragraph further comprising a first manifold in communication with the first plurality of burners for feeding fuel to the first plurality of burners and a second manifold in communication with the second plurality of burners for feeding the second plurality of burners. An embodiment of the invention is one, any or all of prior embodiments in this paragraph up through the first embodiment in this paragraph further comprising a radiant section in the heater comprising the first cell and the second cell and a convection section comprising a convection tube for carrying a fluid material through the heater to heat the fluid material, the convection section includes a cross sectional area which is smaller than the smallest cross sectional area of the radiant section. An embodiment of the invention is one, any or all of prior embodiments in this paragraph up through the first embodiment in this paragraph further comprising an outer wall of the heater that defines the radiant section and a roof over the radiant section extending inwardly from the outer wall. An embodiment of the invention is one, any or all of prior embodiments in this paragraph up through the first embodiment in this paragraph wherein the insulative wall extends through the radiant section to short of the convection section. An embodiment of the invention is one, any or all of prior embodiments in this paragraph up through the first embodiment in this paragraph wherein the insulative wall extends at least 33% of the height of the radiant section. An embodiment of the invention is one, any or all of prior embodiments in this paragraph up through the first embodiment in this paragraph wherein the radiant tube traverses the insulative wall. An embodiment of the invention is one, any or all of prior embodiments in this paragraph up through the first embodiment in this paragraph wherein the radiant tube is serpentine and longest segments of the radiant tube in the first cell have a first orientation that is perpendicular to a second orientation of longest segments of the radiant tube in the second cell. An embodiment of the invention is one, any or all of prior embodiments in this paragraph up through the first embodiment in this paragraph wherein the juxtaposition of the radiant tube and the first plurality of burners in the first cell is different from the juxtaposition of the radiant tube and the second plurality of burners in the second cell. An embodiment of the invention is one, any or all of prior embodiments in this paragraph up through the first embodiment in this paragraph comprising a plurality of radiant tubes wherein a ratio of rows of radiant tubes to rows of burners is different in the first cell than in the second cell. An embodiment of the invention is one, any or all of prior embodiments in this paragraph up through the first embodiment in this paragraph wherein the ratio of an absorbed heat duty of the first cell to an absorbed heat duty of the second cell is 1:1 to 4:1.

A second embodiment of the invention is a process for operating a fired heater comprising feeding fluid material through a tube extending in a first cell of the heater across an insulative wall and extending in a second cell of the heater; feeding fuel to a first plurality of burners in the first cell and combusting the fuel to heat the fluid material in the tube in the first cell; feeding fuel to a second plurality of burners in the second cell and combusting the fuel to heat the fluid material in the tube in the second cell; terminating the flow of fuel to one of the first plurality of burners and the second plurality of burners. An embodiment of the invention is one, any or all of prior embodiments in this paragraph up through the second embodiment in this paragraph further comprising measuring the temperature of the fluid material exiting the heater, comparing it to a set point and closing or opening a main control valve to reduce or increase the flow of fuel to one of the first cell and the second cell. An embodiment of the invention is one, any or all of prior embodiments in this paragraph up through the second embodiment in this paragraph further comprising feeding fuel to pilot lights for all of the burners. An embodiment of the invention is one, any or all of prior embodiments in this paragraph up through the second embodiment in this paragraph further comprising combining a flow of the tube and an additional tube in the first cell into a single tube in the second cell. An embodiment of the invention is one, any or all of prior embodiments in this paragraph up through the second embodiment in this paragraph further comprising transferring more heat to the fluid material in the tube in the first cell than in the second cell. An embodiment of the invention is one, any or all of prior embodiments in this paragraph up through the second embodiment in this paragraph further comprising flowing fluid material predominantly in a first orientation in the tube in the first cell and flowing fluid material predominantly in a second orientation in the tube in the second cell, the first orientation being perpendicular to the second orientation.

A third embodiment of the invention is a fired heater comprising a plurality of walls and a floor; a radiant section and a convection section in the heater, an insulative wall in the radiant section, the insulative wall separating a first cell from a second cell; a radiant tube extending from the first cell to the second cell for carrying a fluid material through the heater to heat the fluid material; a first plurality of burners in the first cell and a second plurality of burners in the second cell; a first manifold in communication with the first plurality of burners for feeding fuel to the first plurality of burners and a second manifold in communication with the second plurality of burners for feeding the second plurality of burners; and a convection tube in the convection section for carrying a fluid material through the heater to heat the fluid material. An embodiment of the invention is one, any or all of prior embodiments in this paragraph up through the third embodiment in this paragraph further comprising an outer wall that defines the radiant section and a roof over the radiant section extending inwardly from the outer wall; the insulative wall extending at least 50% of the height between the floor and the roof. An embodiment of the invention is one, any or all of prior embodiments in this paragraph up through the third embodiment in this paragraph wherein the radiant tube in the radiant section traverses the insulative wall.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A fired heater comprising:

a plurality of walls and a floor;

an insulative wall in a radiant section, said insulative wall separating a first cell of said radiant section from a second cell from said radiant section;

a first plurality of burners in said first cell and a second plurality of burners in said second cell;

a radiant tube extending from said first cell to said second cell for carrying a fluid material through said heater to heat said fluid material; and, a convection section disposed on top of the radiant section such that flue gases from the first plurality of burners and flue gases from the second plurality of burners flow upwards from the radiant section to the convection section, wherein the convection section comprises a convection tube for carrying a fluid material through said heater to heat said fluid material.

2. The fired heater of claim 1 further comprising a first manifold in communication with said first plurality of burners for feeding fuel to said first plurality of burners and a second manifold in communication with said second plurality of burners for feeding said second plurality of burners.

3. The fired heater of claim 1 wherein, said convection section includes a cross sectional area which is smaller than the smallest cross sectional area of said radiant section.

4. The fired heater of claim 1 further comprising an outer wall of said heater that defines said radiant section and a roof over said radiant section extending inwardly from said outer wall.

5. The fired heater of claim 3 wherein said insulative wall extends through the radiant section to short of the convection section.

6. The fired heater of claim 5 wherein said insulative wall extends at least 33% of the height of the radiant section.

7. The fired heater of claim 1 wherein said radiant tube traverses said insulative wall.

8. The fired heater of claim 1 wherein said radiant tube is serpentine and longest segments of said radiant tube in said first cell have a first orientation that is perpendicular to a second orientation of longest segments of said radiant tube in said second cell.

9. The fired heater of claim 1 wherein the juxtaposition of said radiant tube and said first plurality of burners in said first cell is different from the juxtaposition of said radiant tube and said second plurality of burners in said second cell.

10. The fired heater of claim 1 comprising a plurality of radiant tubes wherein a ratio of rows of radiant tubes to rows of burners is different in the first cell than in the second cell.

11. The fired heater of claim 1 wherein the ratio of an absorbed heat duty of the first cell to an absorbed heat duty of the second cell is 1:1 to 4:1.

12. A fired heater comprising:

a heater including a plurality of walls and a floor;

a radiant section and a convection section in said heater, said convection section disposed above said radiant section;

an insulative wall in said radiant section, said insulative wall separating a first cell from a second cell;

a radiant tube extending from said first cell to said second cell for carrying a fluid material through said heater to heat said fluid material;

a first plurality of burners in said first cell and a second plurality of burners in said second cell;

a first manifold in communication with said first plurality of burners for feeding fuel to said first plurality of burners and a second manifold in communication with said second plurality of burners for feeding said second plurality of burners; and a convection tube in said convection section for carrying a fluid material through said heater to heat said fluid material.

13. The fired heater of claim 12 further comprising an outer wall of said heater that defines said radiant section and a roof over said radiant section extending inwardly from said outer wall; said insulative wall extending at least 50% of the height between the floor and the roof.

14. The fired heater of claim 12 wherein said radiant tube in said radiant section traverses said insulative wall.

* * * * *